US011791076B2

(12) United States Patent
Yan et al.

(10) Patent No.: US 11,791,076 B2
(45) Date of Patent: Oct. 17, 2023

(54) SUPERSATURATED SOLID SOLUTION SOFT MAGNETIC MATERIAL AND PREPARATION METHOD THEREOF

(71) Applicant: Zhejiang University, Hangzhou (CN)

(72) Inventors: Mi Yan, Hangzhou (CN); Chen Wu, Hangzhou (CN); Qiming Chen, Hangzhou (CN); Jiaying Jin, Hangzhou (CN)

(73) Assignee: Zhejiang University, Hangzhou (CN)

( * ) Notice: Subject to any disclaimer, the term of this patent is extended or adjusted under 35 U.S.C. 154(b) by 0 days.

(21) Appl. No.: 17/719,067

(22) Filed: Apr. 12, 2022

(65) Prior Publication Data

US 2023/0230734 A1 Jul. 20, 2023

(30) Foreign Application Priority Data

Jan. 18, 2022 (CN) ..... 202210054575.6

(51) Int. Cl.

| | |
|---|---|
| ***H01F 1/14*** | (2006.01) |
| ***C22C 33/06*** | (2006.01) |
| ***C22C 38/02*** | (2006.01) |
| ***C22C 38/10*** | (2006.01) |
| ***C22C 38/14*** | (2006.01) |
| ***H01F 1/147*** | (2006.01) |
| ***H01F 41/02*** | (2006.01) |

(52) U.S. Cl.

CPC ..... *H01F 1/14766* (2013.01); *C22C 33/06* (2013.01); *C22C 38/02* (2013.01); *C22C 38/10* (2013.01); *C22C 38/14* (2013.01); *H01F 41/02* (2013.01); *C22C 2202/02* (2013.01)

(58) Field of Classification Search

None

See application file for complete search history.

(56) References Cited

FOREIGN PATENT DOCUMENTS

| | | | |
|---|---|---|---|
| CN | 101509105 A | * | 8/2009 |
| CN | 101509105 A | | 8/2009 |
| CN | 108611542 A | | 10/2018 |
| CN | 109112344 A | | 1/2019 |
| JP | H10237605 A | | 9/1998 |

OTHER PUBLICATIONS

Chen Qiming et al., "High Frequency Electromagnetic Properties of FeCoSi Magnetic Powders via Phosphorization", Materials China, Mar. 2021, pp. 161-166, vol. 40, No. 3.

CNIPA, Notification of a First Office Action for CN202210054575.6, dated May 18, 2022.

Zhejiang University (Applicant), Reply to Notification of a First Office Action for CN202210054575.6, w/ replacement claims, dated Aug. 18, 2022.

Zhejiang University (Applicant), Supplemental Reply to Notification of a First Office Action for CN202210054575.6, w/ (allowed)replacement claims, dated Sep. 9, 2022.

CNIPA, Notification to grant patent right for invention in CN202210054575.6, dated Sep. 21, 2022.

* cited by examiner

*Primary Examiner* — Anthony M Liang

(57) ABSTRACT

A supersaturated solid solution soft magnetic material and a preparation method thereof are provided, belonging to the field of metal soft magnetic technologies. The supersaturated solid solution soft magnetic material is soft magnetic alloy with proportions of 72.0~78.0 at % Fe, 12.0~18.0 at % Si, 4.0~12.0 at % Co and 1.0~3.0 at % Ti. The preparation method uses molten glass purification or electromagnetic levitation melting to an alloy melt with a target supercooling degree, increases the solid solubility of the Ti element in α-Fe (Si, Co), and promotes the formation of supersaturated solid solution of Ti, thereby achieving the goal that the magnetocrystalline anisotropy constant and the magnetostriction coefficient tend to be zero. Ti element is uniformly distributed in the α-Fe (Si, Co) after supercooled solidification analyzed by X-ray energy spectrometer, a supersaturated solid solution alloy without Ti precipitation is obtained, and the soft magnetic alloy has low coercivity and high permeability.

9 Claims, No Drawings

SUPERSATURATED SOLID SOLUTION SOFT MAGNETIC MATERIAL AND PREPARATION METHOD THEREOF

TECHNICAL FIELD

The disclosure relates to fields of metal soft magnetic technologies, in particular to a supersaturated solid solution soft magnetic material and a preparation method thereof.

BACKGROUND

Iron (Fe)-silicon (Si)-based alloys are currently the most widely used soft magnetic materials, with applications in key fields such as 5th generation mobile communication technology (5G) communication, electronic information, as well as national defense and military industry. For soft magnetic materials, the key performance requirement is quick response to changes of the external magnetic field, which requires low coercivity and high magnetic permeability. Magnetocrystalline anisotropy and magnetostriction are the intrinsic properties that determine the coercivity of soft magnetic alloys. At present, the most effective way to reduce the coercivity and improve the magnetic permeability is to make the saturation magnetostriction coefficient $\lambda s$ and magnetocrystalline anisotropy constant $K_1$ tend to zero simultaneously by adding transition metal elements or non-metal elements. Among many alloying elements, titanium (Ti) can reduce both the magnetocrystalline anisotropy constant and the magnetostrictive coefficient of Fe-based alloys. However, the solid solubility of Ti in $\alpha$-Fe is very small (<1.0 at %), which limits its regulation effect on magnetocrystalline anisotropy and magnetostrictive coefficient. Therefore, obtaining supersaturated solid solution alloys of Ti through a special preparation process is expected to achieve the goal of magnetocrystalline anisotropy and saturation magnetostriction coefficient of Fe—Si-based alloys tending to zero. At present, the preparation methods of the supersaturated solid solution alloys mainly include mechanical alloying and melt-spinning methods. The above two methods tend to introduce a large number of defects such as stress and dislocation in the alloy during the preparation process for seriously deteriorated soft magnetic properties. Moreover, the shape and size of the produced alloy are limited, and only powder and strip alloy can be prepared.

Supercooling solidification can be achieved by increasing the supercooling degree by eliminating heterogeneous nucleation to achieve rapid solidification of the alloy melt. Under supercooling conditions, the solidification of melt will be far away from equilibrium solidification, which can significantly expand the solid solution limit of solute elements, form a single-phase uniform supersaturated solid solution, and solidify at a low cooling rate, resulting in small internal stress. Therefore, the preparation of Fe—Si-based alloy containing Ti supersaturated solid solution by supercooled solidification technology is an effective means to improve the soft magnetic properties.

SUMMARY

Aiming at the problems of low solid solubility of titanium (Ti) in iron (Fe)-silicon (Si)-based alloy and limited regulation of soft magnetic properties, a purpose of the disclosure is to propose a supersaturated solid solution soft magnetic material and a preparation method thereof. The prepared alloy is a supersaturated solid solution without precipitation of elemental Ti and has excellent soft magnetic properties of low coercivity.

In an aspect, the disclosure provides a supersaturated solid solution soft magnetic material, which is realized by the following technical solutions.

Specifically, the supersaturated solid solution soft magnetic material includes raw materials of Fe, Si, cobalt (Co) and Ti. Proportions of the respective raw materials include 72.0~78.0 atomic percent (at %) Fe, 12.0~18.0 at % Si, 4.0~12.0 at % Co and 1.0~3.0 at % Ti.

In another aspect, the disclosure provides a preparation method of the supersaturated solid solution soft magnetic material. The preparation method may include: performing one of molten glass purification and electromagnetic levitation melting on the raw materials to obtain the supersaturated solid solution soft magnetic material.

In an embodiment, the molten glass purification may specifically include:

- step (1), weighing the raw materials according to the proportions, and performing one of arc melting and induction melting on the raw materials under one of a first vacuum condition and a first protective atmosphere to obtain a master alloy;
- step (2), placing the master alloy and a glass denucleating agent into a high-temperature resistant quartz glass tube to make an upper surface and a lower surface of the master alloy to be covered with the glass denucleating agent;
- step (3), placing the quartz glass tube with the master alloy and the glass denucleating agent in a radio-frequency induction coil, and then heating radio-frequency induction coil with a certain power under one of a second vacuum condition and a second protective atmosphere to melt the glass denucleating agent and coat the melted glass denucleating agent onto surfaces of the master alloy through metal heat conduction;
- step (4), increasing the heating power of the radio-frequency induction coil to melt the master alloy coated with the melted glass denucleating agent to obtain a resultant alloy melt, then raising to a temperature in a range of 1300~1500 degrees Celsius (° C.) to make the resultant alloy melt overheat, stopping the heating of the resultant alloy melt after heat preserving the resultant alloy melt for 2~5 minutes, and cooling the resultant alloy melt naturally to obtain a resultant alloy; and
- step (5), cycle overheating including: repeatedly performing a treatment of "the heating of the resultant alloy melt—the heat preserving of the resultant alloy melt—the cooling of the resultant alloy melt" on the resultant alloy, and measuring a temperature of the resultant alloy melt in real time, stopping the treatment when the resultant alloy melt obtains a target supercooling degree, and obtaining the supersaturated solid solution soft magnetic material after supercooling solidification of the resultant alloy melt.

In an embodiment, the electromagnetic levitation melting may specifically include:

- step (a), weighing the raw materials according to the proportions, and performing one of arc melting and induction melting on the raw materials under one of a third vacuum condition and a third protective atmosphere to obtain a master alloy;
- step (b), placing the master alloy in a suspended electromagnetic field to suspend the master alloy in a center of a heating coil depending on a Lorentz force formed by an interaction between the suspended electromagnetic field and an induced current;

step (c), inductively heating the suspended master alloy under one of a fourth vacuum condition and a fourth protective atmosphere by using the heating coil to obtain a resultant alloy melt, heating the resultant alloy melt to a temperature in a range of 1300~1500° C. to make the resultant alloy melt overheat, stopping the heating of the resultant alloy melt after heat preserving the resultant alloy melt for 2~5 minutes, and then cooling the resultant alloy melt naturally to a resultant alloy; and step (d), cycle overheating including: repeatedly performing a treatment of "the heating of the resultant alloy melt—the heat preserving of the resultant alloy melt—the cooling of the resultant alloy melt" on the resultant alloy, and measuring a temperature of the resultant alloy melt in real time, stopping the treatment when the resultant alloy melt obtains a target supercooling degree, and making the resultant alloy melt nucleate and solidify to obtain the supersaturated solid solution soft magnetic material.

In an embodiment, the step (1) may specifically include: using an electromagnetic stirring to perform the one of arc melting and induction melting on the raw materials, and repeatedly melting the master alloy for 4~6 times to ensure that the raw materials distribute uniformly in the master alloy.

In an embodiment, each of the first vacuum condition and the second vacuum condition is in a vacuum state of less than $5\times10^{-3}$ Pascals (Pa); and each of the first protective atmosphere and the second protective atmosphere is one of an argon gas and a nitrogen gas with a purity no less than 99.9 volume percent (vol %).

In an embodiment, the glass denucleating agent may include: main bodies of silicon dioxide ($SiO_2$) and sodium silicate ($Na_2SiO_3$), and stabilizers of calcium oxide (CaO), magnesium oxide (MgO), aluminium oxide ($Al_2O_3$) and ferric oxide ($Fe_2O_3$). Proportions of the respective main bodies and the stabilizers are 59.0~75.0 wt % $SiO_2$, 15.0~31.0 wt % $Na_2SiO_3$, 4.0~7.0 wt % CaO, 1.8~2.0 wt % MgO, 1.0~2.0 wt % $Al_2O_3$, and 0.1~0.3 wt % $Fe_2O_3$.

In an embodiment, the glass denucleating agent is prepared by: mixing $SiO_2$, $Na_2SiO_3$, CaO, MgO, $Al_2O_3$ and $Fe_2O_3$ in the proportions to obtain a mixture, and burning the mixture at a temperature in a range of 800~900° C. for 5~8 hours. A mass of the glass denucleating agent is in a range of 20~25% of a mass of the master alloy In an embodiment, the step (a) may specifically include: using an electromagnetic stirring to perform the one of arc melting and induction melting on the raw materials, and repeatedly melting the master alloy for 4~6 times to ensure that the raw materials distribute uniformly in the master alloy.

In an embodiment, each of the third vacuum condition and the fourth vacuum condition is in a vacuum state of less than $5\times10^{-3}$ Pa; and each of the third protective atmosphere and the fourth protective atmosphere is one of an argon gas and a nitrogen gas with a purity no less than 99.9 vol %.

In the supersaturated solid solution soft magnetic material of the disclosure, the transition metal element Ti is introduced to regulate the magnetostrictive coefficient and magnetocrystalline anisotropy constant of the alloy. Compared with other transition metal elements, Ti can reduce both the magnetostrictive coefficient and magnetocrystalline anisotropy constant, and the regulation effect is more obvious, resulting in less magnetic dilution. Through the reasonable proportions of Fe, Co, Si and Ti, the magnetostrictive coefficient and magnetocrystalline anisotropy constant of the alloy tend to be zero, and the saturation magnetization of the alloy is maintained.

The supersaturated solid solution soft magnetic material of the disclosure adopts the supercooled rapid solidification method of molten glass purification or electromagnetic levitation melting to increase the solid solubility of Ti element and improve the regulation effect of Ti element on magnetic properties. Compared with the traditional mechanical alloying and melt-spinning methods, the solidification of the alloy of the disclosure is carried out at a lower cooling rate, avoiding the introduction of defects such as internal stress and dislocation, and optimizing the soft magnetic properties.

In combination with the above, the magnetocrystalline anisotropy constant and magnetostrictive coefficient of the supersaturated solid solution soft magnetic material obtained by supercooling solidification tend to be zero, and the material has excellent soft magnetic properties of low coercivity and high permeability.

DETAILED DESCRIPTION OF EMBODIMENTS

Embodiment 1

A supersaturated solid solution soft magnetic material, in atomic percent, is a soft magnetic alloy with proportions of iron (Fe) 72.0 atomic percent (at %), silicon (Si) 16.0 at %, cobalt (Co) 11.0 at %, and titanium (Ti) 1.0 at %. A preparation method of soft magnetic alloy (i.e., supersaturated solid solution soft magnetic material) may include the following steps.

Step (1), pure Fe particles, pure Co particles, pure Ti particles and pure polycrystalline Si blocks as raw materials are weighed with a total weight of 40.0 grams (g) according to the proportions. The raw materials are placed into an arc-melting furnace, and remelted for 4 times under a protective atmosphere of high-purity argon gas as protective gas to obtain a master alloy with uniform components.

Step (2), glass denucleating agent burning specifically includes: 59.0 wt % silicon dioxide ($SiO_2$), 31.0 wt % sodium silicate ($Na_2SiO_3$), 7.0 wt % calcium oxide (CaO), 1.8 wt % magnesium oxide (MgO), 1.0 wt % aluminium oxide ($Al_2O_3$) and 0.2 wt % ferric oxide ($Fe_2O_3$) are weighed and mixed to obtain a mixture, and the mixture is burned at 800 degrees Celsius (° C.) for 5 hours to obtain the glass denucleating agent.

Step (3), 6.0 g master alloy and 1.2 g glass denucleating agent are placed into a high-temperature resistant quartz glass tube, and an upper surface and a lower surface of the master alloy are covered with the glass denucleating agent.

Step (4), the high-temperature resistant quartz glass tube with the master alloy and the glass denucleating agent is placed in a radio-frequency induction coil, vacuumed until an air pressure is less than $5\times10^{-3}$ Pascals (Pa), the radio-frequency induction coil is heated with a low power, and the glass denucleating agent is melted and coated onto surfaces of the master alloy through metal heat conduction.

Step (5), the heating power of the radio-frequency induction coil is increased to melt the master alloy coated with the melted glass denucleating agent to obtain a resultant alloy melt, the resultant alloy melt is heated to 1350° C. to make the resultant alloy melt overheat, the heating of the resultant alloy melt is stopped after heat preserving the resultant alloy melt for 2 minutes, and the resultant alloy melt is cooled naturally to obtain a resultant alloy.

Step (6), the resultant alloy is heated to 1350° C. again, the heating is stopped after heat preserving for 2 minutes. The treatment of "the heating of the resultant alloy melt—the heat preserving of the resultant alloy melt—the cooling of the resultant alloy melt" is repeatedly performed on the resultant alloy, a temperature of the resultant alloy melt is measured in real time by using an infrared thermometer, the treatment is stopped when the supercooling degree of the resultant alloy melt is not less than 150° C., and the supersaturated solid solution soft magnetic material is obtained after supercooling solidification of the resultant alloy melt.

It is found that Ti is uniformly distributed in the α-Fe (Si, Co) crystal grains by measuring the prepared alloy (i.e., the soft magnetic alloy) through X-ray energy dispersive spectroscopy (EDS). The saturation magnetization and coercivity of the alloy are 168.0 emu/g and 0.34 Oersted (Oe) respectively by measuring the static magnetic hysteresis loop of the prepared alloy.

Embodiment 2

A supersaturated solid solution soft magnetic material, in atomic percent, is a soft magnetic alloy with proportions of Fe 75.0 at %, Si 14.0 at %, Co 9.0 at % and Ti 2.0 at %. A preparation method of the soft magnetic alloy may include the following steps.

Step (1), pure Fe particles, pure Co particles, pure Ti particles and pure polycrystalline Si blocks as raw materials are weighed with a total weight of 60.0 g according to the proportions. The raw materials are placed into an arc-melting furnace, and remelted for 6 times with electromagnetic stirring under a vacuum condition of an air pressure less than $4\times10^{-3}$ Pa to obtain a master alloy with uniform components.

Step (2), glass denucleating agent burning specifically includes: 71.7 wt % $SiO_2$, 20.0 wt % $Na_2SiO_3$, 4.0 wt % CaO, 2.0 wt % MgO, 2.0 wt % $Al_2O_3$ and 0.3 wt % $Fe_2O_3$ are weighed and mixed to obtain a mixture, and the mixture is burned at 900° C. for 8 hours to obtain the glass denucleating agent.

Step (3), 8.0 g master alloy and 2.0 g glass denucleating agent are placed into a high-temperature resistant quartz glass tube, and an upper surface and a lower surface of the master alloy are covered with the glass denucleating agent.

Step (4), the high-temperature resistant quartz glass tube with the master alloy and the glass denucleating agent is placed in a radio-frequency induction coil, high-purity nitrogen gas is introduced as protective gas, the radio-frequency induction coil is heated with a low power, and the glass denucleating agent is melted and coated onto surfaces of the master alloy through metal heat conduction.

Step (5) the heating power of the radio-frequency induction coil is increased to melt the master alloy coated with the melted glass denucleating agent to obtain a resultant alloy melt, the resultant alloy melt is heated to 1300° C. to make the resultant alloy melt overheat, the heating of the resultant alloy melt is stopped after heat preserving of the resultant alloy melt for 3 minutes, and the resultant alloy melt is cooled naturally to obtain a resultant alloy.

Step (6) the resultant alloy is heated to 1300° C. again, the heating is stopped after heat preserving for 3 minutes. The treatment of "the heating of the resultant alloy melt—the heat preserving of the resultant alloy melt—the cooling of the resultant alloy melt" is repeatedly performed on the resultant alloy, a temperature of the resultant alloy melt is measured in real time, the treatment is stopped when the supercooling degree of the resultant alloy melt is not less than 200° C., and the supersaturated solid solution soft magnetic material is obtained after supercooling solidification of the resultant alloy melt.

It is found that Ti is uniformly distributed in the α-Fe (Si, Co) crystal grains by measuring the prepared alloy through X-ray energy dispersive spectroscopy (EDS). The saturation magnetization and coercivity of the alloy are 175.0 emu/g and 0.30 Oe respectively by measuring the static magnetic hysteresis loop of the prepared alloy.

Embodiment 3

A supersaturated solid solution soft magnetic material, in atomic percent, is a soft magnetic alloy with proportions of Fe 73.0 at %, Si 14.5 at %, Co 10.0 at % and Ti 2.5 at %. A preparation method of the soft magnetic alloy may include the following steps.

Step (1), pure Fe particles, pure Co particles, pure Ti particles and pure polycrystalline Si blocks as raw materials are weighed with a total weight of 60.0 g according to the proportions. The raw materials are placed into an arc melting furnace, and remelted for 6 times with an electromagnetic stirring under a vacuum condition of an air pressure less than $5\times10^{-3}$ Pa to obtain a master alloy with uniform components.

Step (2), 10.0 g master alloy is placed in a suspended electromagnetic field, and the master alloy is stably suspended in a center of a heating coil by a Lorentz force formed by an interaction between the suspended electromagnetic field and an induced current.

Step (3), the suspended master alloy is inductively heated to 1400° C. by using the heating coil under a vacuum condition of an air pressure less than $4\times10^{-3}$ Pa, the heating is stopped after heating preserving for 5 minutes, thereby obtaining a resultant alloy melt, and the resultant alloy melt is cooled naturally to obtain a resultant alloy.

Step (4), the resultant alloy is heated to 1400° C. again, the heating is stopped afterheat preserving for 5 minutes. The treatment of "the heating of the resultant alloy melt—the heat preserving of the resultant alloy melt—the cooling of the resultant alloy melt" is repeatedly performed on the resultant alloy, a temperature of the resultant alloy melt is measured in real time, the treatment is stopped when the supercooling degree of the resultant alloy melt is not less than 350° C., and the supersaturated solid solution soft magnetic material is obtained after nucleus formation and solidification of the resultant alloy melt.

It is found that Ti is uniformly distributed in the α-Fe (Si, Co) crystal grains by measuring the prepared alloy through X-ray energy dispersive spectroscopy (EDS). The saturation magnetization and coercivity of the alloy are 170.0 emu/g and 0.28 Oe respectively by measuring the static magnetic hysteresis loop of the prepared alloy.

Embodiment 4

A supersaturated solid solution soft magnetic material, in atomic percent, is a soft magnetic alloy with proportions of Fe 78.0 at %, Si 15.0 at %, Co 4.0 at % and Ti 3.0 at %. A preparation method of the soft magnetic alloy may include the following steps.

Step (1), pure Fe particles, pure Co particles, pure Ti particles and pure polycrystalline Si blocks as raw materials are weighed with a total weight of 50.0 g according to the proportions. The raw materials are placed into an arc melting furnace, and remelted for 6 times with an electromagnetic stirring under a vacuum condition of an air pressure less than $4\times10^{-3}$ Pa to obtain a master alloy with uniform components.

Step (2), 12.0 g master alloy is placed in a suspended electromagnetic field, and the master alloy is stably suspended in a center of a heating coil by a Lorentz force formed by an interaction between the suspended electromagnetic field and an induced current.

Step (3), the suspended master alloy is inductively heated to 1500° C. by using the heating coil under a protective atmosphere of high-purity argon gas as protective gas, the heating is stopped after heat preserving for 4 minutes, thereby obtaining a resultant alloy melt, and the resultant alloy melt is cooled naturally to obtain a resultant alloy.

Step (4), the resultant alloy is heated to 1500° C. again, the heating is stopped after heat preserving for 4 minutes. The treatment of "the heating of the resultant alloy melt—the heat preserving of the resultant alloy melt—the cooling of the resultant alloy melt" is repeatedly performed on the resultant alloy, a temperature of the resultant alloy melt is measured in real time, the treatment is stopped when the supercooling degree of the resultant alloy melt not less than 400° C., and the supersaturated solid solution soft magnetic material is obtained after nucleus formation and solidification of the resultant alloy melt.

It is found that Ti is uniformly distributed in the α-Fe (Si, Co) crystal grains by measuring the prepared alloy through X-ray energy dispersive spectroscopy (EDS). The saturation magnetization and coercivity of the alloy are 178.0 emu/g and 0.19 Oe respectively by measuring the static magnetic hysteresis loop of the prepared alloy.

What is claimed is:

1. A preparation method of a supersaturated solid solution soft magnetic material, comprising:

performing one of molten glass purification and electromagnetic levitation melting on raw materials of the supersaturated solid solution soft magnetic material to obtain the supersaturated solid solution soft magnetic material;

wherein the raw materials of the supersaturated solid solution soft magnetic material comprises: iron (Fe), silicon (Si), cobalt (Co) and titanium (Ti);

wherein proportions of the raw materials comprise 72.0-78.0 atomic percent (at %) Fe, 12.0-18.0 at % Si, 4.0-12.0 at % Co and 1.0-3.0 at % Ti.

2. The preparation method according to claim 1, wherein the molten glass purification comprises:

step (1), weighing the raw materials according to the proportions, and performing one of arc melting and induction melting on the raw materials under one of a first vacuum condition and a first protective atmosphere to obtain a master alloy;

step (2), placing the master alloy and a glass denucleating agent into a quartz glass tube to make an upper surface and a lower surface of the master alloy be covered with the glass denucleating agent;

step (3), placing the quartz glass tube with the master alloy and the glass denucleating agent in a radio-frequency induction coil, and then heating the radio-frequency induction coil with a certain power under one of a second vacuum condition and a second protective atmosphere to melt the glass denucleating agent and coat the melted glass denucleating agent onto surfaces of the master alloy through metal heat conduction;

step (4), increasing the heating power of the radio-frequency induction coil to melt the master alloy coated with the melted glass denucleating agent to obtain a resultant alloy melt, heating the resultant alloy melt to a temperature in a range of 1300-1500 degrees Celsius (° C.) to make the resultant alloy melt overheat, stopping the heating of the resultant alloy melt after heat preserving the resultant alloy melt for 2-5 minutes, and cooling the resultant alloy melt naturally to obtain a resultant alloy; and step (5), cycle overheating comprising: repeatedly performing a treatment of "the heating of the resultant alloy melt—the heat preserving of the resultant alloy melt—the cooling of the resultant alloy melt" on the resultant alloy, measuring a temperature of the resultant alloy melt in real time, stopping the treatment when the resultant alloy melt obtains a target supercooling degree, and obtaining the supersaturated solid solution soft magnetic material after supercooling solidification of the resultant alloy melt.

3. The preparation method according to claim 1, wherein the electromagnetic levitation melting comprises:

step (a), weighing the raw materials according to the proportions, and performing one of arc melting and induction melting on the raw materials under one of a third vacuum condition and a third protective atmosphere to obtain a master alloy;

step (b), placing the master alloy in a suspended electromagnetic field to suspend the master alloy in a center of a heating coil depending on a Lorentz force formed by an interaction between the suspended electromagnetic field and an induced current;

step (c), inductively heating the suspended master alloy under one of a fourth vacuum condition and a fourth protective atmosphere by using the heating coil to obtain a resultant alloy melt, heating the resultant alloy melt to a temperature in a range of 1300-1500° C. to make the resultant alloy melt overheat, stopping the heating of the resultant alloy melt after heat preserving the resultant alloy melt for 2-5 minutes, and then cooling the resultant alloy melt naturally to a resultant alloy; and step (d), cycle overheating comprising: repeatedly performing a treatment of "the heating of the resultant alloy melt—the heat preserving of the resultant alloy melt—the cooling of the resultant alloy melt" on the resultant alloy, and measuring an temperature of the resultant alloy melt in real time, stopping the treatment when the resultant alloy melt obtains a target supercooling degree, and making the resultant alloy melt nucleate and solidify to obtain the supersaturated solid solution soft magnetic material.

4. The preparation method according to claim 2, wherein the step (1) comprises:

using electromagnetic stirring to perform the one of arc melting and induction melting on the raw materials, and repeatedly melting the master alloy 4-6 times to ensure that the raw materials distribute uniformly in the master alloy.

5. The preparation method according to claim 2, wherein each of the first vacuum condition and the second vacuum condition is in a vacuum state of less than $5\times10^{-3}$ Pascals (Pa); and wherein each of the first protective atmosphere and the second protective atmosphere is one of an argon gas and a nitrogen gas with a purity no less than 99.9 volume percent (vol %).

6. The preparation method according to claim 2, wherein the glass denucleating agent comprises:

main bodies including silicon dioxide ($SiO_2$) and sodium silicate ($Na_2SiO_3$); and stabilizers including calcium oxide (CaO), magnesium oxide (MgO), aluminium oxide ($Al_2O_3$) and ferric oxide ($Fe_2O_3$);

wherein proportions of the respective main bodies and the stabilizers are 59.0-75.0 wt % $SiO_2$, 15.0-31.0 wt % $Na_2SiO_3$, 4.0-7.0 wt % CaO, 1.8-2.0 wt % MgO, 1.0-2.0 wt % $Al_2O_3$, and 0.1-0.3 wt % $Fe_2O_3$.

7. The preparation method according to claim 6, wherein the glass denucleating agent is prepared by:

mixing $SiO_2$, $Na_2SiO_3$, CaO, MgO, $Al_2O_3$ and $Fe_2O_3$ in the proportions to obtain a mixture, and burning the mixture at a temperature in a range of 800-900° C. for 5-8 hours;

wherein a mass of the glass denucleating agent is in a range of 20-25% of a mass of the master alloy.

8. The preparation method according to claim 3, wherein the step (a) comprises:

using electromagnetic stirring to perform the one of arc melting and induction melting on the raw materials, and repeatedly melting the master alloy 4-6 times to ensure that the raw materials distribute uniformly in the master alloy.

9. The preparation method according to claim 3, wherein each of the third vacuum condition and the fourth vacuum condition is in a vacuum state of less than $5\times10^{-3}$ Pa; and wherein each of the third protective atmosphere and the fourth protective atmosphere is one of an argon gas and a nitrogen gas with a purity no less than 99.9 vol %.

* * * * *